US009324524B2

(12) United States Patent
Kawaguchi et al.

(10) Patent No.: US 9,324,524 B2
(45) Date of Patent: Apr. 26, 2016

(54) ELECTROMAGNETIC RELAY

(75) Inventors: Kensuke Kawaguchi, Yamaga (JP); Kazuchika Hiroki, Kumamoto (JP); Ikuhiro Yoshihara, Yamaga (JP); Tomohiro Yamakita, Kikuchi (JP); Haruki Ayado, Yamaga (JP); Tomomi Yoshiyama, Kikuchi (JP); Hiroyuki Iwasaka, Kumamoto (JP)

(73) Assignee: OMRON Corporation, Kyoto (JP)

( * ) Notice: Subject to any disclaimer, the term of this patent is extended or adjusted under 35 U.S.C. 154(b) by 27 days.

(21) Appl. No.: 14/123,280

(22) PCT Filed: May 29, 2012

(86) PCT No.: PCT/JP2012/063778

§ 371 (c)(1),
(2), (4) Date: Dec. 2, 2013

(87) PCT Pub. No.: WO2012/165433

PCT Pub. Date: Dec. 6, 2012

(65) Prior Publication Data

US 2015/0123753 A1 May 7, 2015

(30) Foreign Application Priority Data

May 31, 2011 (JP) ..... 2011-122041

(51) Int. Cl.
*H01H 67/02* (2006.01)
*H01H 50/20* (2006.01)
(Continued)

(52) U.S. Cl.
CPC ..... *H01H 50/20* (2013.01); *H01H 50/22* (2013.01); *H01H 51/065* (2013.01); *H01H 2050/025* (2013.01); *H01H 2050/446* (2013.01)

(58) Field of Classification Search
CPC ..... H01H 2050/025; H01H 50/546; H01H 50/54; H01H 50/045
USPC ..... 335/78, 128–131
See application file for complete search history.

(56) References Cited

U.S. PATENT DOCUMENTS 7,852,178 B2 * 12/2010 Bush et al. ..... 335/126
8,674,796 B2 * 3/2014 Ito et al. ..... 335/260
(Continued)

FOREIGN PATENT DOCUMENTS

JP 2006310249 A 11/2006
JP 2010-010058 A 1/2010

OTHER PUBLICATIONS

International Search Report for corresponding application PCT/JP2012/063778 filed May 29, 2012; Mail date Jun. 26, 2012.
(Continued)

*Primary Examiner* — Bernard Rojas
(74) *Attorney, Agent, or Firm* — Shinjyu Global IP

(57) ABSTRACT

An electromagnetic relay includes a movable iron core arranged to move up and down within a center hole of an electromagnet unit formed by winding a coil, and a contact switch where an upper end surface of the movable iron core attaches to and detaches from a lower end surface of a fixed iron core arranged in the center hole according to magnetization and demagnetization of the electromagnet unit and a movable contact attaches to and detaches from a fixed contact by a movable shaft which reciprocates along with the movable iron core where the movable iron core includes a sliding portion which always abuts an auxiliary yoke disposed within a yoke, and where a height dimension of the sliding portion is at least equal to or larger than a plate thickness dimension of the yoke.

9 Claims, 7 Drawing Sheets

(51) Int. Cl.

| | |
|---|---|
| *H01H 51/06* | (2006.01) |
| *H01H 50/44* | (2006.01) |
| *H01H 50/02* | (2006.01) |
| *H01H 50/22* | (2006.01) |

(56) References Cited

U.S. PATENT DOCUMENTS

| | | | | |
|---|---|---|---|---|
| 8,760,247 | B2 * | 6/2014 | Isozaki et al. | 335/201 |
| 8,823,472 | B2 * | 9/2014 | Takaya et al. | 335/133 |
| 8,975,989 | B2 * | 3/2015 | Yano et al. | 335/132 |
| 2006/0050466 | A1 * | 3/2006 | Enomoto et al. | 361/160 |
| 2009/0322453 | A1 | 12/2009 | Kawaguchi et al. | |

OTHER PUBLICATIONS

Japanese Office Action for corresponding application JP 2013-518104; Report Dated Oct. 7, 2014.

The Search Report from the corresponding European Patent Application No. 12792427.2 issued on May 13, 2015.

* cited by examiner (A)

(B)

(A)

(B)

| | Example 1 | Example 2 | Comparative Example |
|---|---|---|---|
| Spring mounting force | Fo | Fo | Fo |
| Spring constant | K | K | K |
| Total mass of movable part | 0.86m | 0.64m | m |
| Movement energy (J) | 0.0141 | 0.0106 | 0.0165 |
| Calculated moving distance of movable part (mm) | $x_{Gap}$-0.153 | $x_{Gap}$-0.541 | $x_{Gap}$+0.268 |
| Calculated impact resistance value (G) | 65.4 | 78.9 | 52.9 |
| Actually-measured impact resistance value (G) | 69.6 | 74.4 | 53.3 |

ELECTROMAGNETIC RELAY

CROSS REFERENCE TO RELATED APPLICATION

This application, filed under 35 U.S.C. 371, is the U.S. national phase of International Patent Application Number PCT/JP2012/063778 filed on 29 May 2012 which claims priority to Japanese Patent Application Number 2011-122041 filed on 31 May 2011, all of which said applications are herein incorporated by reference in their entirety.

TECHNICAL FIELD

The present invention relates to an electromagnetic relay and more particularly to an electromagnetic relay excellent in impact resistance.

BACKGROUND ART

In a conventional electromagnetic relay, there is a contact device including a fixed terminal provided with a fixed contact, a movable terminal provided with a movable contact configured to attach to and detach from the fixed contact, a cylindrical movable shaft having an end to which the movable contact is fixed, a movable iron core fixed to the other end of the movable shaft, a fixed iron core which is externally inserted into the movable shaft and faces the movable contact and the movable iron core, an electromagnet device which generates magnetic attraction force between the fixed iron core and the movable iron core, thus causing the movable iron core to move and reach the fixed iron core, and a return spring which is interposed between the movable iron core and the fixed iron core and elastically biases the movable iron core so as to be separated from the fixed iron core. In the contact device, the electromagnetic device includes, inside a cylindrical shaft portion thereof, the movable shaft, the fixed iron core, a coil bobbin into which the movable iron core is inserted, a coil which is wound around a shaft portion of the coil bobbin, and a yoke configured to accommodate the coil and the coil bobbin inside thereof and provided with a through hole which is formed in a center of a bottom surface and configured to communicate with a hole of the shaft portion of the coil bobbin. In the contact device, a rising piece which rises toward an inside of the shaft portion from a circumferential edge of the through hole is provided in the yoke. In the contact device, the movable iron core includes a larger diameter portion which faces the fixed iron core along a moving direction and a smaller diameter portion which has a smaller diameter than the larger diameter portion and faces the rising piece in a direction orthogonal to the moving direction. Such a conventional contact device is, for example, disclosed in Japanese Unexamined Patent Publication No. 2006-310249.

However, in the contact device, when impact force is externally applied in an axial direction of the cylindrical movable shaft during non-excitation, for example, there is a possibility that the movable contact comes into contact with the fixed contact due to the force of inertia of the whole movable parts and thus the contact device malfunctions. For this reason, in order to increase an impact resistance, a measure of increasing biasing force with an increase in spring constant of the return spring is considered. However, in terms of securing smooth operation property, it is necessary to increase an attraction force of the electromagnet device rather than the increase of the biasing force of the return spring. For this reason, there is a problem that a high application voltage needs to be applied to drive the movable parts and thus power consumption increases.

SUMMARY OF INVENTION

The present invention is made in view of the above problems and the invention provides an energy-saving electromagnetic relay excellent in impact resistance.

An electromagnetic relay is provided including a movable iron core arranged to move up and down in an axial center hole of a solenoid formed by winding a coil, a contact switch where an upper end surface of the movable iron core attaches to and detaches from a lower end surface of a fixed iron core arranged in the axial center hole according to magnetization and demagnetization of the solenoid, and a movable contact attaches to and detaches from a fixed contact by a movable shaft which reciprocates along with the movable iron core, and a sliding portion arranged at a lower side of an annular groove portion formed in an exterior circumferential surface of the movable iron core, where the sliding portion is disposed in an auxiliary yoke having a cylindrical shape which is provided in a yoke, wherein the sliding portion always abuts the auxiliary yoke during the up and down movement of the movable iron core, and where a height dimension of the sliding portion is at least equal to or larger than a plate thickness dimension of the yoke.

An electromagnetic relay is further provided as including a movable iron core arranged to move up and down within an axial center hole of a solenoid formed by winding a coil, a contact switch wherein an upper end surface of the movable iron core attaches to and detaches from a lower end surface of a fixed iron core arranged in the axial center hole according to magnetization and demagnetization of the solenoid, and a movable contact attaches to and detaches from a fixed contact by a movable shaft which reciprocates along with the movable iron core, a bored portion provided in an opening edge portion of a lower end surface of the movable iron core; and a sliding portion comprising an exterior circumferential surface of the movable iron core, the sliding portion disposed in an auxiliary yoke having a cylindrical shape which is provided in a yoke, where the sliding portion always abuts the auxiliary yoke during the up and down movement; and where a height dimension of the sliding portion is at least equal to or larger than a plate thickness dimension of the yoke.

DETAILED DESCRIPTION

Embodiments of an electromagnetic relay according to the present invention are described with reference to the accompanying drawings of FIGS. 1 through FIG. 6.

Although terms expressing specific directions and positions, such as "upper", "lower", "side", and "end", are used in the following description if necessary, those terms are used to make an understanding of the invention easier with reference to the drawings, and the technical scope of the present invention is not limited by definitions of the terms. Furthermore, the following description is basically only for illustration and is not intended to restrict the present invention, and application or use of the present invention.

An electromagnetic relay according to a first embodiment roughly includes a contact mechanism unit 1 and an electromagnet unit 2 as illustrated in FIGS. 1 to 4.

Figure 3:
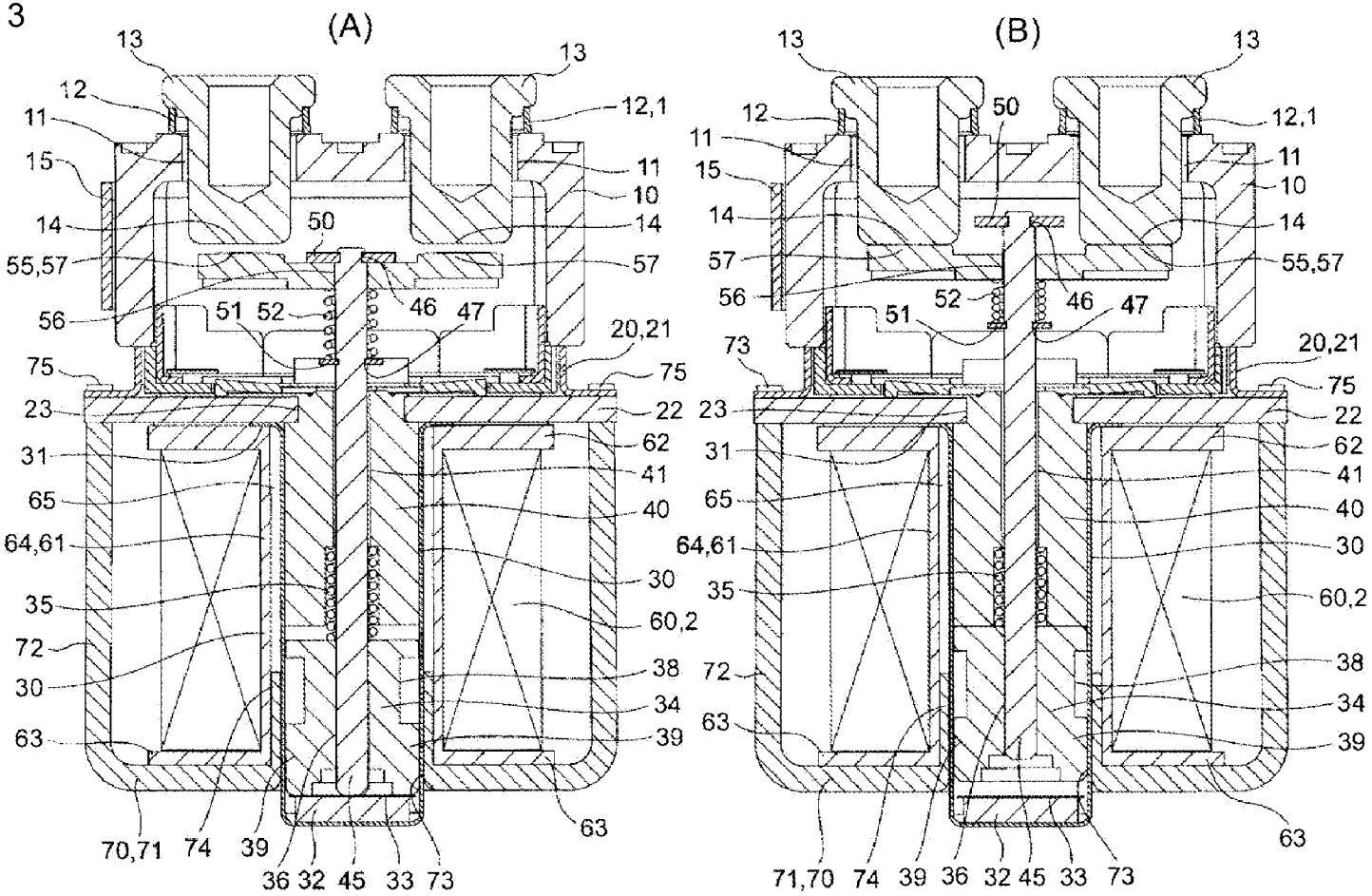
FIGS. 3A and 3B are sectional views taken along line A-A of FIG. 2 which illustrate states before and after operation, respectively.

As illustrated in FIG. 3, the contact mechanism unit 1 includes a ceramic case 10, a connection ring 12, a fixed contact terminal 13, a flange member 20, a first yoke 22. The contact mechanism unit 1 includes a movable iron core 34, a fixed iron core 40, a movable shaft 45, and a movable contact piece 55 provided inside a sealed space formed in a closed-end barrel 30.

Figure 1:
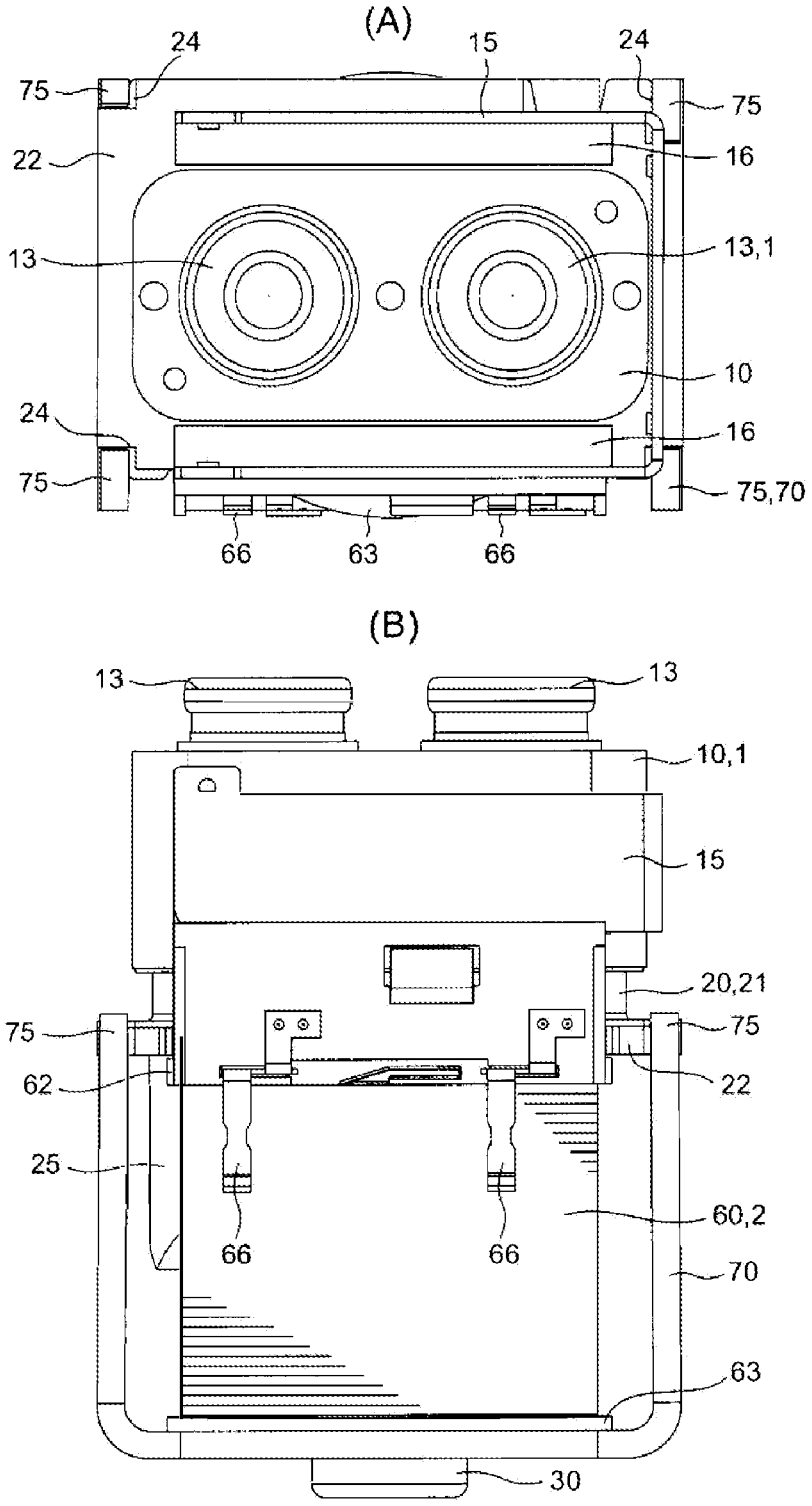
FIGS. 1A and 1B are a plan view and a front view, respectively illustrating a first embodiment of an electromagnetic relay according to the present invention.
Figure 2:
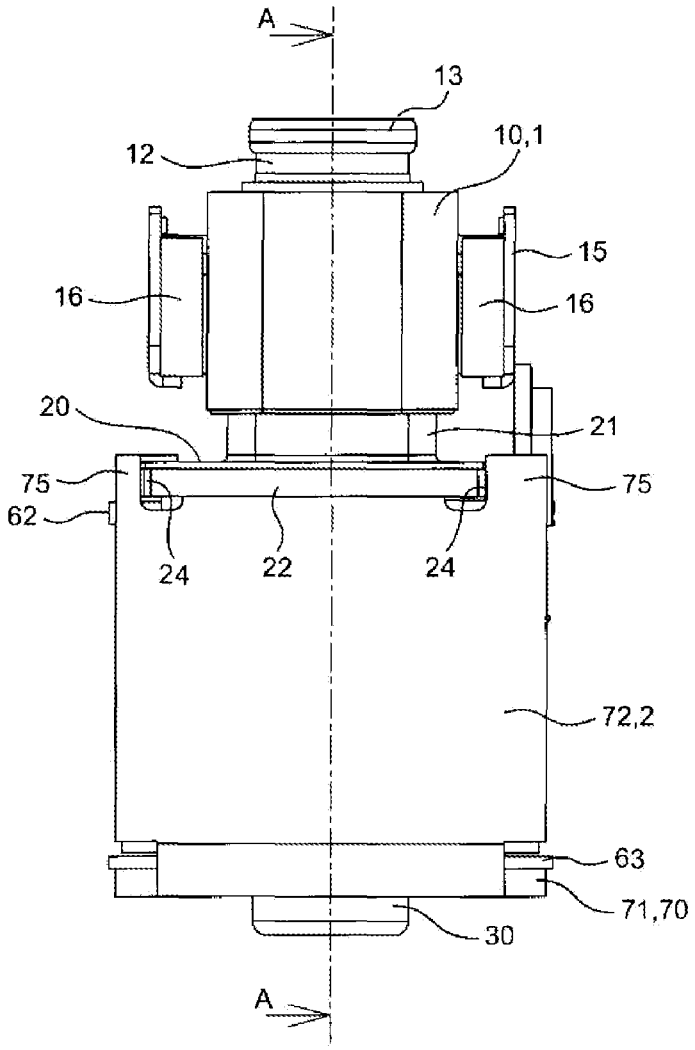
FIG. 2 is a left side view illustrating the electromagnetic relay of FIG. 1.

As illustrated in FIG. 3, the ceramic case 10 has an almost rectangular parallelepiped shape which has an open bottom. An upper surface of the ceramic case 10 has two terminal holes 11 and 11. An annular metal layer, not illustrated, is formed at an upper opening edge of each terminal hole 11 through a deposition method or the like. In addition, the fixed contact terminal 13 is provided at the ceramic case 10 via a cylindrical connection ring 12 brazed to the annular metal layer, respectively. The fixed contact terminal 13 includes a disk-shaped fixed contact 14 brazed to a lower end surface thereof. As illustrated in FIGS. 1 and 2, a pair of permanent magnets 16 and 16 are attached to a front surface and a back surface of the ceramic case 10, respectively which face each other via approximately C-shaped holders 15. The permanent magnets 16 extend arc which occurs during a contact switch in a predetermined direction using magnetism and thus extinguish the arc.

The flange member 20 is prepared by performing press processing on a metallic plate material which is almost rectangular in a plan view, thus forming a rectangular cylinder portion 21 which is approximately rectangular in a plan view in a center portion of the metallic plate material. Next, the rectangular cylinder portion 21 is brazed in a state in which an upper end edge portion of the rectangular cylinder portion 21 is in contact with a lower opening end surface of the ceramic case 10.

The first yoke 22 is prepared by performing press processing on a metallic plate material which is electrically conductive and is almost rectangular in a plan view, and has a circular opening 23 at a center portion. An upper end portion of the fixed iron core 40 described below is caulked and fixed to the opening 23. As illustrated in FIGS. 1 and 2, notches 24 are formed in four corners of the first yoke 22, respectively. Engagement projections 75 of a second yoke 70 described below engage with the notches 24 as illustrated in FIG. 1A.

The closed-end barrel 30 has a guard portion 31 formed around an upper side opening. Aside from an impact absorber 32 and a thin plate 33 made of stainless steel, the movable iron core 34, return spring 35, and fixed iron core 40 are accommodated in the closed-end barrel 30. In addition, in the closed-end barrel 30, the guard portion 31 is air-tightly, integrally joined to the lower surface edge portion of the opening 23 of the first yoke 22.

Figure 4:
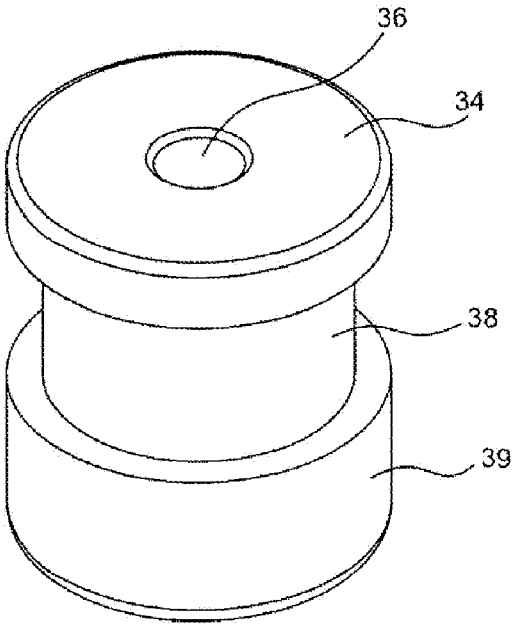
FIGS. 4A and 4B are a perspective view and a cross-sectional view of a movable iron core, respectively which is illustrated in FIGS. 3A and 3B.
Figure 4:
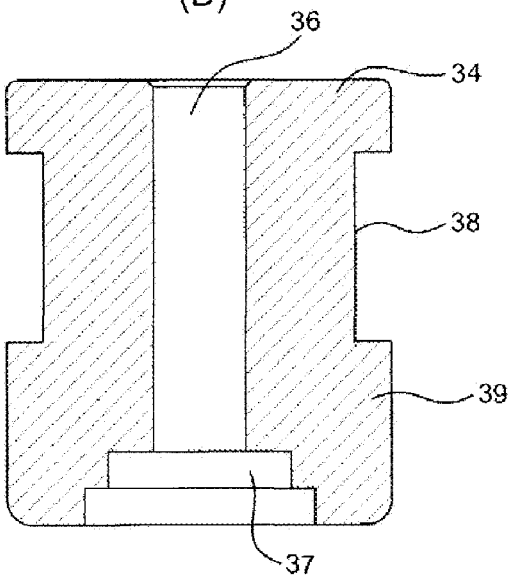

Particularly, as illustrated in FIG. 4, the movable iron core 34 is a magnetic material having a cylindrical shape, has a center hole 36 which penetrates through upper and lower end surfaces thereof and a stepped hole 37 in a lower opening of the center hole 36. Furthermore, the movable iron core 34 has an annular groove portion 38 in the exterior circumferential surface so that the weight of the movable iron core 34 is reduced. The movable iron core 34 has a sliding portion 39 which faces an auxiliary yoke 74 provided in a second yoke 70 described below in a lower side of the annular groove portion 38 in order to maintain magnetization efficiency. The sliding portion 39 of the movable iron core 34 is configured to always face the auxiliary yoke 74 provided in the second yoke 70 described below in terms of magnetization efficiency. More strictly speaking, an area of the movable iron core 34 which faces the auxiliary yoke 74 is desirably constant regardless of an up-and-down movement of the movable iron core 34. Specifically, when a leading end of the auxiliary yoke 74 is configured to always face the annular groove portion 38 at the time of the up-and-down movement of the movable iron core 34, the area can be made to be constant. Herein, the term 'always faces' is used to mean that at least some portion of the sliding portion 39 is adjacent to, abuts, and is aligned with at least a portion of the auxiliary yoke 74 throughout the full distance of travel of the movable iron core 34. In other words, throughout the full up and down movement of the moveable iron core 34, an axis can be passed perpendicularly through some portion of the sliding portion 39 and said axis will perpendicularly intersect some portion of the auxiliary yoke 74. Furthermore, desirably a height dimension of the sliding portion 39 is set to be equal to or larger than a plate thickness dimension of the second yoke 70.

The lower end surface of the movable iron core 34 in a state where the movable iron core 34 is detached from and positioned to be farthest from the fixed iron core 40 may be flush with a lower surface of the auxiliary yoke 74 or may be shifted toward the fixed iron core 40 from the lower surface of the auxiliary yoke 74. Accordingly, when the movable iron core 34 is situated in a lowest position, a stable attraction force can be obtained without a reduction in magnetic flux flows to the movable iron core.

The fixed iron core 40 has a cylindrical shape. The fixed iron core 40 has a center hole 41 which penetrates through upper and lower surfaces thereof. Although not illustrated in detail in the drawings, the center hole 41 is a stepped hole including a larger diameter hole at a lower end side and a smaller diameter hole at an upper end side, and a step portion in the boundary between the larger diameter portion and the smaller diameter portion serves as a contact surface of a return spring 35. In addition, an upper end portion of the fixed iron core 40 is slightly smaller in an outer diameter than the other portion, so that the upper end portion is fitted into the opening 23 of the first yoke 22 so as to be caulked and fixed to the opening 23.

The movable shaft 45 has the stepped portion 46 having a smaller outer diameter in an exterior circumferential surface of an upper end portion thereof, and an annular groove portion 47 which is positioned below the stepped portion 46 and distanced by a predetermined length from the stepped portion 46. A locking ring 50 is caulked and fixed to the stepped portion 46, and an E ring 51 can be attached to the annular groove portion 47. After the movable shaft 45 in which the locking ring 50 is caulked and fixed to the stepped portion 46 is inserted into a through hole 56 of the movable contact piece 55 described below, and a contact spring 52 is mounted, the E ring 51 is attached to the annular groove portion 47. Therefore, the movable contact piece 55 is biased toward the locking ring 50 by the contact spring 52.

The movable contact piece 55 is a strip-shaped plate member made of a nonmagnetic material, for example, pure copper: C1020, and the through hole 56 is formed in a center portion. Respective ends of the movable contact piece 55 have a slightly smaller width, and are provided with disk-shaped movable contacts 57 and 57 which are formed to protrude upward through press processing.

The electromagnet unit 2 is configured such that a spool 61 around which a coil 60 is wound is fitted into and unified with the auxiliary yoke 74 provided in the second yoke 70.

The spool 61 is configured such that an upper guard portion 62 and a lower guard portion 63 are connected by a cylindrical drum section 64 and the closed-end barrel 30 is inserted into a center hole 65 of the drum section 64. The upper guard portion 62 has a disk shape having a larger outer diameter than an exterior circumferential surface of the coil 60 which is wound. In addition, coil terminals 66 and 66 are press-fitted into and unified with the upper guard portion 62. On the other hand, the lower guard portion 63 is almost the same in shape as a bottom surface portion of the second yoke, and is formed in a disk shape which conforms the exterior circumferential surface of the coil 60 which is wound.

The second yoke 70 includes a bottom surface portion 71 and a pair of side surface portions 72 and 72 orthogonally extending from respective edges of the bottom surface portion 71. In this manner, the second yoke 70 has an almost C-shaped cross section. And the bottom surface portion 71 of the second yoke 70 has an opening 73 in the center. In addition, a cylindrical auxiliary yoke 74 extends upward from a lower opening edge portion of the opening 73. Further, the engagement protrusions 75 to engage with the notches 24 of the first yoke 20 are formed at upper end portions of the side surface portions 72 of the second yoke 70, respectively.

Next, a method of assembling a sealed electromagnetic relay having the above-described configuration is described.

The connection ring 12 is arranged in a metal layer formed in an upper surface of the ceramic case 10. In addition, a shaft portion of the fixed contact terminal 13 is inserted into the connection ring 12 and is brought into contact with the upper opening edge portion of the connection ring 12. In addition, the rectangular cylinder portion 21 of the flange member 20 is arranged in the lower opening end surface of the ceramic case 10. In addition, these members in this state are brazed and unified. Of course, the fixed contact 14 is arranged on the lower end surface of the fixed contact terminal 13 in advance.

An air-venting pipe 25 illustrated in FIG. 1B is brazed to an air-venting hole of the first yoke 22 which is not illustrated. In addition, an upper end portion of the fixed iron core 40 is inserted into the opening 23 of the first yoke 22, and thus caulked and fixed to the opening 23 of the first yoke 22. Subsequently, the locking ring 50 is caulked and fixed to the stepped portion 46 of the movable shaft 45. Next, after an end portion of the movable shaft 45 is inserted into the through hole 56 of the movable contact piece 55 and a contact spring 52 is mounted from below, the E ring 51 is press-fitted into the annular groove portion 47 of the movable shaft 45. Thus, the contact spring 52 is clamped between the movable contact piece 55 and the E ring 51, and the movable contact piece 55 is brought into tight contact with the locking ring 50.

The movable shaft 45 is inserted into the center hole 41 of the fixed iron core 40 which is caulked and fixed to the first yoke 22 from above the first yoke 22. Then, the flange member 20 unified with the ceramic case 10 or the like is arranged on the upper surface of the first yoke 22, and the first yoke 22 and the flange member 20 are air-tightly joined to each other through laser welding. Subsequently, the return spring 35 is inserted into the center hole 41 of the fixed iron core 40. In addition, the first yoke 22 and the flange member 20 are joined through laser welding in a state in which the movable shaft 45 is inserted in the center hole 36 of the movable iron core 34. On the other hand, the impact absorber 32 and the thin plate 33 are inserted into the closed-end barrel 30. Then, the guard portion 31 of the closed-end barrel 30 is air-tightly joined to a periphery portion of the opening 23 of the bottom surface of the first yoke 22 through laser welding. Subsequently, after an insulating gas is jetted into an interior space of the ceramic case 10 which is air-tightly sealed via the air-venting pipe 25, the air-venting pipe 25 is subjected to cold-rolling so as to be sealed.

Thus, in the contact mechanism unit 1 formed in this manner, the movable iron core 34 is arranged under the fixed iron core 40 via the return spring 35, and the lower end surface of the movable iron core 34 comes into tight contact with the thin plate 33 arranged on the bottom surface of the closed-end barrel 30 and thus is positioned in an initial state. When the electromagnet unit 2 is magnetized and the movable iron core 34 is moved upward as described above, the spring force of the return spring 35 which acts on the movable iron core 34 increases. Therefore, when the electromagnet unit 2 is not excited, the movable iron core 34 can be automatically returned to the initial state.

Next, the coil 60 is wound around the drum section 64 of the spool 61, and an insulating seal, which is not illustrated, is pasted thereon. After lead wires of the coil 60 are tangled and soldered to coil terminals 66 and 66 press-fitted into the upper guard portion 62 of the spool 61, respectively and the coil terminals 66 and 66 are bent and hung down. Subsequently, the auxiliary yoke 74 which protrudes upward from the bottom surface of the second yoke 70 is press-fitted into the center hole 65 of the spool 61, and the electromagnet unit 2 is completed.

The contact mechanism unit 1 and the electromagnet unit 2 are assembled by inserting the closed-end barrel 30 of the contact mechanism unit 1 into the center hole 65 of the spool 61 and engaging the engagement protrusions 75 of the second yoke 70 with the notches 24 of the first yoke 22. The sealed electromagnetic relay is completed by attaching the pair of permanent magnets 16 and 16 to the front and back surfaces of the ceramic case 10 via the holders 15.

Figure 5:
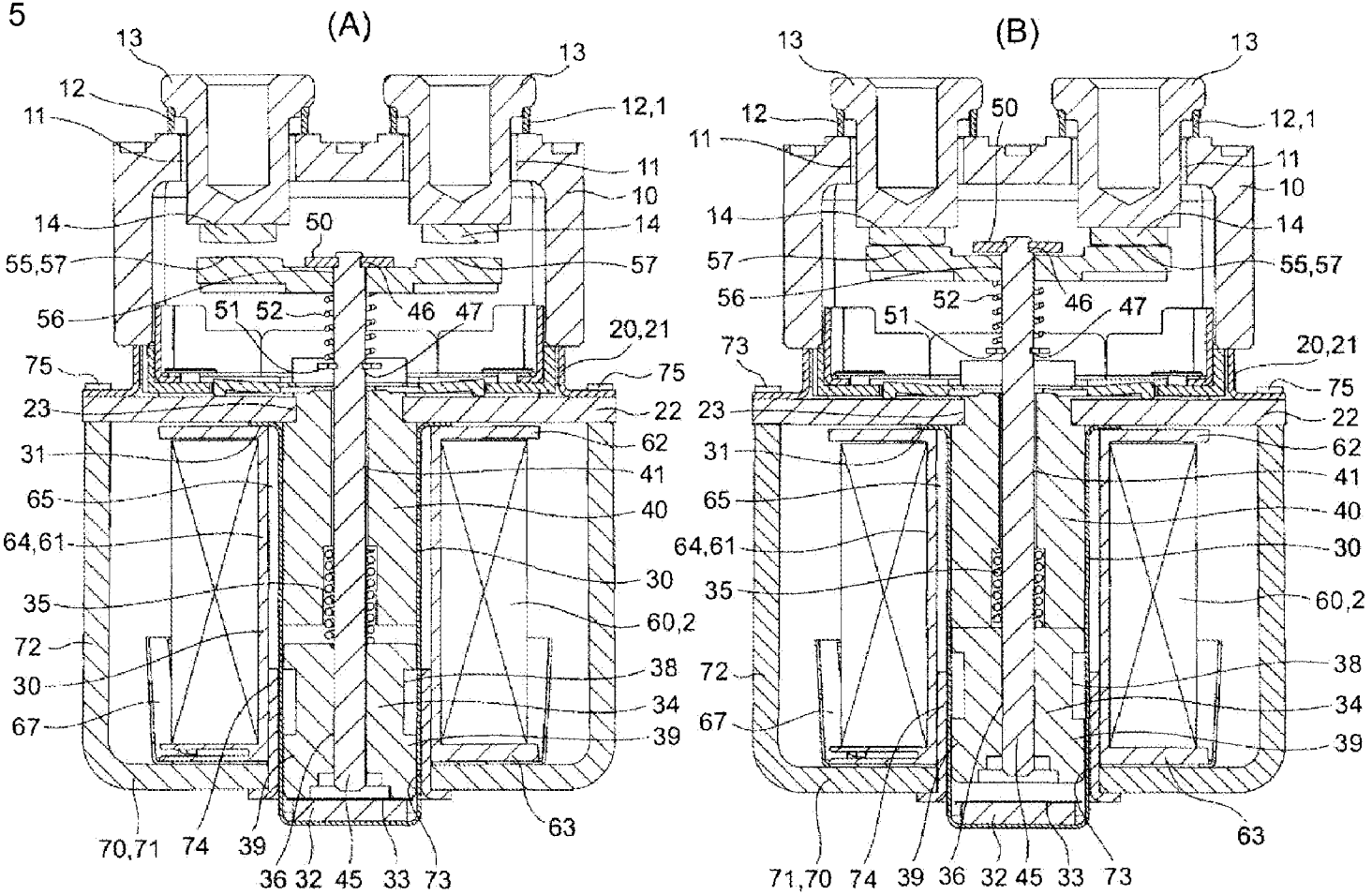
FIGS. 5A and 5B are sectional views illustrating states before and after operation of a second embodiment of the electromagnetic relay according to the present invention, respectively.

A second embodiment, illustrated in FIG. 5, is almost the same as the first embodiment but differs in that an auxiliary yoke 74 and a second yoke 70 are provided as separate structures and the auxiliary yoke 74 is assembled in a manner to continuously protrude upward from a bottom surface of the second yoke 70.

In order to secure an insulation distance between a coil terminal fitted into a lower guard portion 63 of a spool 61 and the second yoke 70, an insulating member of a thin body which has a through hole in a center and has a sectional cup shape is clamped between the lower guard portion 63 and a bottom surface portion 71 of the second yoke 70.

Portions the same as those of the first embodiment are represented by the same reference signs, and a description thereof is omitted.

Figure 6:
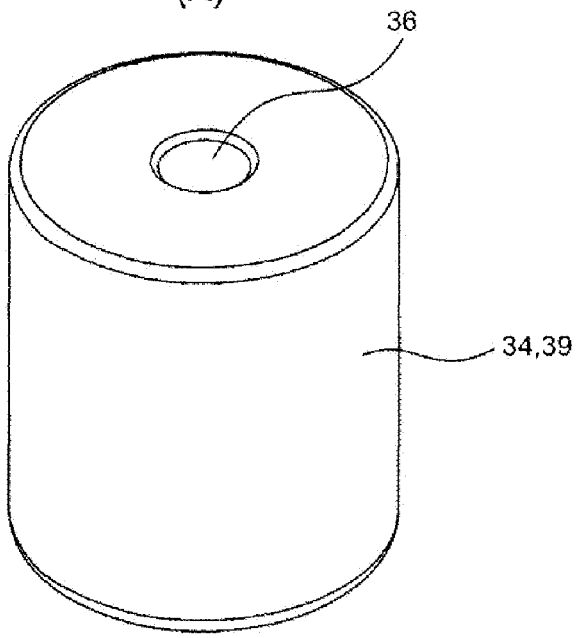
FIGS. 6A and 6B are a perspective view and a cross-sectional view, respectively illustrating a movable iron core of a third embodiment of the electromagnetic relay according to the present invention.
Figure 6:
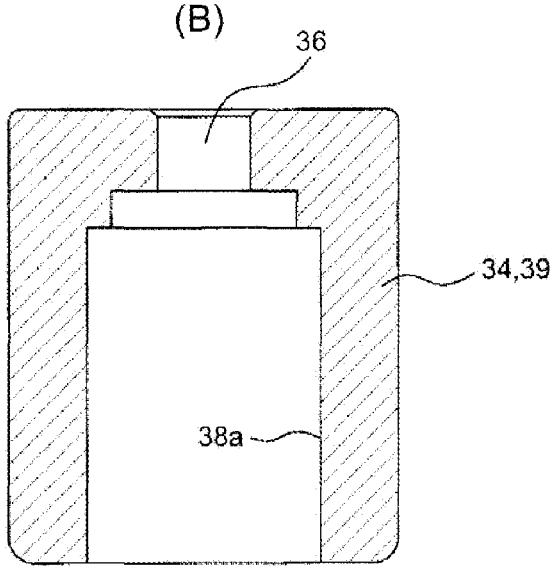

As illustrated in FIG. 6, a third embodiment is a case where weight reduction is achieved by forming a bored portion 38*a* by performing boring processing on a lower opening edge portion of a center hole 36 of a movable iron core 34.

According to the present example, since an exterior circumferential surface is flat-tapped and there is no level difference in a sliding portion 39, there is an advantage that magnetic resistance is small and magnetic efficiency is not likely to be lowered.

Since other features of the embodiment of FIG. 6 are almost the same as those of the first embodiment, respective descriptions thereabout are omitted.

Next, operation of the sealed electromagnetic relay having the configuration described above is described.

In a state where an electromagnet unit 2 is not excited, i.e., where no voltage is applied to a coil 60, as shown in FIG. 3A, a movable iron core 34 is biased toward a lower side by a spring force of a return spring 35, and a movable shaft 45 is pressed down. For this reason, a movable contact piece 55 moves down and a movable contact 57 detaches from a fixed contact 14 and maintains an open state.

When a voltage is applied to the coil 60 and the electromagnet unit 2 is magnetized, magnetic flux will flow into a magnetic circuit configured by a fixed iron core 40, the movable iron core 34, an auxiliary yoke 74, a second yoke 70, and a first yoke 22. At this time, a gap exists between the movable iron core 34 and the fixed iron core 40, and the movable iron core 34 is arranged to be movable up and down. Therefore, as illustrated in FIG. 3B, an upper end portion of the movable iron core 34 is attracted to a lower end portion of the fixed iron core 40, and thus is moved up against the biasing force of the return spring 35. In connection with this, the movable shaft 45 and the movable contact piece 55 move together, and the movable contact piece 55 is switched to close with respect to the fixed contact 14.

When the electromagnet unit 2 is demagnetized, the movable iron core 34 will be detached from the fixed iron core 40 based on the spring force of the contact spring 52 and the return spring 35. For this reason, after the movable shaft 45 slides down and the movable contact 57 is switched to open with respect to the fixed contact 14, the movable iron core 34 comes into contact with an impact absorber 32 via a thin plate 33 made from stainless steel, and returns to an original state.

Example 1

Regarding an impact resistance of the electromagnetic relay according to the present invention, a calculated moving distance and a calculated impact resistance value are obtained, and an actually measured impact resistance value is also obtained. The result is shown in FIG. 8.

Figures 7, 8:
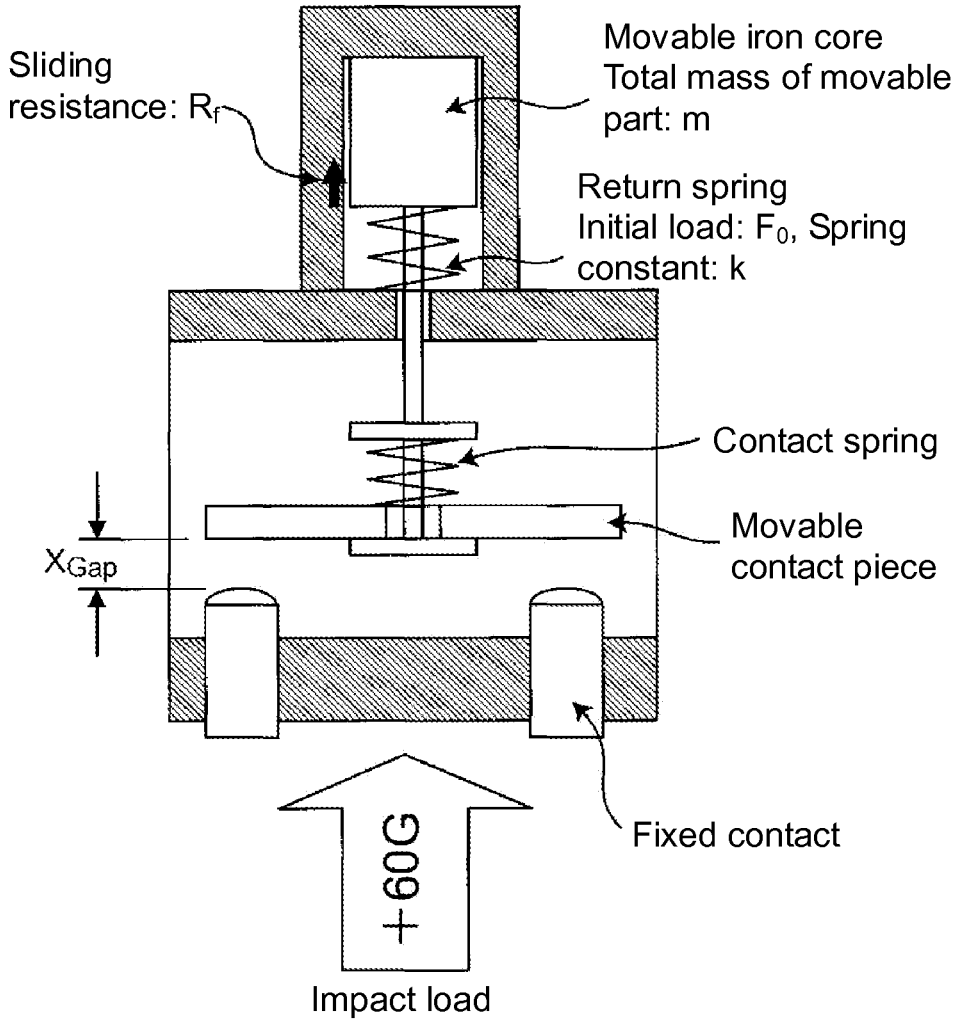
FIG. 7 is a schematic sectional view for describing an experimental method.
FIG. 8 is a chart showing experimental conditions and results.

Examples 1 and 2 illustrated in FIG. 8 were cases where weight reduction was achieved by providing an annular groove portion in an exterior circumferential surface of a movable iron core, and a spring constant of a contact spring was fixed. A comparative example was a case where the annular groove portion was not provided and the spring constant of the contact spring varied.

The calculated moving distance and calculated impact resistance value are calculated using the following formula on the assumption that total energy before a collision occurs and total energy in a state in which a movable part moved to a bottom dead center of a spring are equal to each other.

$$\tfrac{1}{2}\cdot(kx_1+F_0)x_1+\tfrac{1}{2}\cdot mv_1^2+mgx_1=\tfrac{1}{2}\cdot(kx_2+F_0)x_2+\tfrac{1}{2}\cdot mv_2^2+mgx_2+R_f$$

In the above formula, k is spring constant, $x_1$ is spring displacement before a collision, $x_2$ is spring displacement after a collision, $F_0$ is spring mounting force, m is total mass of movable parts, $v_1$ is speed before a collision, $v_2$ is speed after a collision, and Rf is sliding-resistance energy.

Further, since collision speed at which an impact load of 60 G is generated by an existing impact test machine was a speed determined by free fall from a height of h=0.12 (m) and the collision speed was $v_1=(2\ gh)^{1/2}$, the collision speed was set to $v_1=1.534$ (m/sec).

Furthermore, when the spring constant k and spring mounting force $F_0$ of a comparative example were the same as those of examples 1 and 2 and when the spring displacement before a collision was $x_1=0$ (mm), the displacement $x_2$ of the spring was calculated at the bottom dead center for a case where the speed after a collision was $V_2=0$. At this time, in order to prevent malfunction, the displacement $x_2$ of the spring after a collision needs to be equal to or smaller than a distance-between-contacts $x_{Gap}$.

When it was assumed that the impact load of 60 G was loaded in an axial direction of a movable shaft in the above formula and condition, a moving distance of the whole movable part in the axial direction was calculated as the calculated moving distance. The calculation result is shown in FIG. 8.

When it was assumed that the impact load of 60 G was loaded as shown in FIG. 8, the calculated moving distances in examples 1 and 2 in which the weight of the movable iron core was reduced by 14% or 36% compared to comparative example were equal to or smaller than $x_{Gap}$. When the calculated moving distance is equal to or smaller than the distance-between-contacts $x_{Gap}$, the movable contact does not come into contact with the fixed contact. Accordingly, malfunctions did not occur in examples 1 and 2.

On the other hand, the movable contact came into contact with the fixed contact and malfunction occurred in the comparative example because the calculated moving distance of comparative example exceeded the distance-between-contacts $x_{Gap}$.

When the impact load was loaded in the axial direction of the movable shaft, the impact value, i.e., calculated impact resistance value, at which the movable part is displaced as long as the distance-between-contacts $x_{Gap}$ and the malfunction occurs was calculated.

Furthermore, in order to confirm whether the calculated result is in compliance with characteristics of an actual electromagnetic relay, as shown in FIG. 7, the impact value, actually-measured impact resistance value, at which malfunction occurred was measured in a state in which the actual electromagnetic relay was inverted and the movable part was displaced by the distance-between-contacts $x_{Gap}$ was measured. In FIG. 7, the fixed iron core is not illustrated for convenience of description.

A calculation result and a measurement result are shown in FIG. 8.

As shown in FIG. 8, it was confirmed that in examples 1 and 2, both of the calculated impact resistance value and the actually-measured impact resistance value at which malfunction occurs exceeded 60 G, malfunction was difficult to occur, and an impact resistance was excellent. Furthermore, since the calculated impact resistance value and the actually-measured impact resistance value were approximate to each other in examples 1 and 2, it was confirmed that the calculation result was reliable.

On the other hand, in the comparative example, since the calculation impact resistance value and actually-measured impact resistance value at which malfunction occurs are equal to or smaller than 60 G and malfunction easily occurs, it was obvious that the comparative example was inferior to examples 1 and 2 in impact resistance.

Therefore, it was confirmed that an impact resistance improves with decrease in weight in the movable iron core.

Example 2

For examples 1 and 2, the annular groove portion is provided in the exterior circumferential surface of the movable iron core which weighs 0.86 m and 0.64 m, respectively. For the comparative example, the annular groove portion is not provided in the exterior circumferential surface of the movable iron core and weighs m. For the various examples, operation sound and return sound are measured individually. Measurement results are shown below.

| | Operation sound (dB) | Return sound (dB) |
|---|---|---|
| Example 1 | 58.5 | 51.0 |
| Example 2 | 55.1 | 50.6 |
| Comparative Example | 63.6 | 58.5 |

It was found from the above measurement results that examples 1 and 2 exhibited decreases of 5.1 dB and 8.5 dB in the operation sound, respectively compared to the comparative example, and decreases of 7.5 dB and 7.9 dB in the return sound, respectively compared to the comparative example.

Accordingly, it was confirmed that the sound is reduced as the weight of the movable iron core is decreased.

The present invention is not limited to the configuration described in the above embodiments, and various changes to the embodiments are possible.

According to the present invention, since the movable iron core is reduced in weight and force of inertia is small, even though an impact force is applied in an axial direction of the movable shaft, the whole movable part becomes difficult to be displaced, and thus an electromagnetic relay which is unlikely to malfunction is obtained. Furthermore, since it is unnecessary to increase an application voltage for prevention of malfunction, there is an advantage that an energy-saving electromagnetic relay which consumes less electric power is obtained.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. An electromagnetic relay comprising:

a movable iron core arranged to move up and down in an axial center hole of a solenoid formed by winding a coil;

a contact switch wherein an upper end surface of the movable iron core attaches to and detaches from a lower end surface of a fixed iron core arranged in the axial center hole according to magnetization and demagnetization of the solenoid, and a movable contact attaches to and detaches from a fixed contact by a movable shaft which reciprocates along with the movable iron core; and a sliding portion arranged at a lower side of an annular groove portion, the annular groove portion formed in an exterior circumferential surface of the movable iron core, and wherein a permanent magnet is not arranged within the annular groove portion;

wherein the sliding portion is disposed in an auxiliary yoke having a cylindrical shape which is provided in a yoke;

wherein the sliding portion always abuts the auxiliary yoke during the up and down movement of the movable iron core; and wherein a height dimension of the sliding portion is at least equal to or larger than a plate thickness dimension of the yoke.

2. The electromagnetic relay according to claim 1, wherein an area of the sliding portion which abuts the auxiliary yoke is constant regardless of the up and down movements of the movable iron core.

3. The electromagnetic relay according to claim 1, wherein a leading end of the auxiliary yoke always abuts the annular groove portion when the movable iron core moves up and down.

4. The electromagnetic relay according to claim 1,

Wherein, when the movable iron core is moved down and is most separated from the fixed iron core, a lower end surface of the movable iron core is located flush with a lower surface of the auxiliary yoke or in a position adjacent to the lower surface and shifted toward the fixed iron core.

5. The electromagnetic relay according to claim 2, wherein a leading end of the auxiliary yoke always abuts the annular groove portion when the movable iron core moves up and down.

6. The electromagnetic relay according to claim 2, wherein, when the movable iron core is moved down and is most separated from the fixed iron core, a lower end surface of the movable iron core is located flush with a lower surface of the auxiliary yoke or in a position adjacent to the lower surface and shifted toward the fixed iron core.

7. The electromagnetic relay according to claim 3, wherein, when the movable iron core is moved down and is most separated from the fixed iron core, a lower end surface of the movable iron core is located flush with a lower surface of the auxiliary yoke or in a position adjacent to the lower surface and shifted toward the fixed iron core.

8. The electromagnetic relay according to claim 5, wherein, when the movable iron core is moved down and is most separated from the fixed iron core, a lower end surface of the movable iron core is located flush with a lower surface of the auxiliary yoke or in a position adjacent to the lower surface and shifted toward the fixed iron core.

9. An electromagnetic relay comprising:

a movable iron core arranged to move up and down in an axial center hole of a solenoid formed by winding a coil;

a contact switch wherein an upper end surface of the movable iron core attaches to and detaches from a lower end surface of a fixed iron core arranged in the axial center hole according to magnetization and demagnetization of the solenoid, and a movable contact attaches to and detaches from a fixed contact by a movable shaft which reciprocates along with the movable iron core; and a sliding portion arranged at a lower side of an annular groove portion, the annular groove portion formed in a center area of an exterior circumferential surface of the movable iron core, the exterior circumferential surface of the movable iron core having a uniform diameter, and wherein a permanent magnet is not arranged within the annular groove portion;

wherein the sliding portion is disposed in an auxiliary yoke having a cylindrical shape which is provided in a yoke;

wherein the sliding portion always abuts the auxiliary yoke during the up and down movement of the movable iron core; and wherein a height dimension of the sliding portion is at least equal to or larger than a plate thickness dimension of the yoke.

* * * * *